US005783043A

United States Patent [19]

Christensen

[11] Patent Number: 5,783,043

[45] Date of Patent: Jul. 21, 1998

[54] PAPER COATING APPARATUS

[76] Inventor: Leif Christensen, 811 Range, Manistique, Mich. 49854

[21] Appl. No.: 584,229

[22] Filed: Jan. 11, 1996

[51] Int. Cl.[6] ..... B05C 1/14; B05B 7/00

[52] U.S. Cl. ..... 162/265; 162/266; 118/257; 118/264; 118/303; 118/313

[58] Field of Search ..... 162/266, 265, 162/184, 135; 118/257, 264, 300, 303, 313; 134/122 R, 127; 427/261

[56] References Cited

U.S. PATENT DOCUMENTS

| | | | |
|---|---|---|---|
| 1,336,528 | 4/1920 | Low | 427/363 |
| 1,966,458 | 7/1934 | Novak | 162/265 X |
| 1,981,803 | 11/1934 | Hedstrom, Jr. | 162/266 |
| 1,999,049 | 4/1935 | Hedstrom, Jr. | 162/266 |
| 2,060,897 | 11/1936 | Richardson et al. | 91/43 |
| 2,227,494 | 1/1941 | Gold | 91/55 |
| 2,246,531 | 6/1941 | Novak | 91/18 |
| 3,461,032 | 8/1969 | Lichtenberger | 162/266 |
| 3,484,275 | 12/1969 | Lewicki, Jr. | 117/93.4 |
| 3,680,779 | 8/1972 | Reilly | 239/3 |
| 3,850,675 | 11/1974 | Miller | 117/93.31 |
| 4,605,612 | 8/1986 | Asao et al. | 430/538 |
| 4,610,956 | 9/1986 | Fuchizawa et al. | 430/538 |
| 4,731,285 | 3/1988 | Anthonsen | 428/323 |
| 5,225,140 | 7/1993 | Hayashikoshi | 264/571 |

FOREIGN PATENT DOCUMENTS

| | | | |
|---|---|---|---|
| 427531 | 4/1926 | Germany | 162/265 |

*Primary Examiner*—Stanley S. Silverman
*Assistant Examiner*—Jose A. Fortuna
*Attorney, Agent, or Firm*—Dickinson Wright PLLC

[57] ABSTRACT

An apparatus for depositing various coating materials on a traveling web by passing the coating through a dispersing medium. The web of material in traveling through processing or handling machinery may be effectively and desirably spray coated in-line by equipping the same with the apparatus of the present invention. The coated material is sprayed onto the inside surface of a permeable conveyor and transferred through to the web.

15 Claims, 1 Drawing Sheet

PAPER COATING APPARATUS

FIELD OF THE INVENTION

The present invention relates to a process and apparatus for dispensing material to an object. More specifically, the present invention relates to a method and apparatus for depositing various liquid, semi-liquid, liquefiable and dry materials onto a moving web of material. In a still more specific aspect, the present invention relates to an in-line method and apparatus for depositing coating materials such as pigments, binders, optical brighteners, starches, static retardants, wetting agents, lubricants, surfactants, synthetic resins and like materials onto a wet fibrous web in a paper making process.

It is to be understood that the term "web" in the specification and claims is intended to include single thin webs, thick webs and/or plied webs.

It has heretofore been the practice to apply coating materials on to the surface of moving webs of paper and like materials utilizing many different techniques including spray coating such as by electrostatic attraction apparatus (U.S. Pat. No. 3,848,275). Unfortunately, a great deal of difficulty has been experienced with these techniques including uneven coating and excessive use/lose of coating materials. Specifically, the conventional spray coating techniques when used on high speed printing operations suffered substantial effects on the free falling material caused by the air turbulence. The result was a significant departure from an ideal uniform coating since the atomized coating particles are lightweight. Elaborate precautions, such as the inclusion of air curtains and the like, have been taken to eliminate the so-called "fly-around" caused by air movement. These methods are quite costly and have not been altogether successful.

In addition, irrespective of the spray technique used to coat the surface of the web, uneven coverage is experienced when more than one dispensing outlet is utilized, since a certain degree of overlap or underlay is inevitable.

Another and even less desirable technique for applying coating materials to paper and the like is to dip the web of material in the coating solution (U.S. Pat. No. 2,246,531) or apply it by a partially submerged roller. There are many disadvantages of these techniques including, waste of material, oversaturation, unevenness of coating, the necessity of drying to remove excess coating material and carrier, etc. In addition, it is well established that in dip coating processes many of the coating materials typically used have a tendency to foam. The only way in which such foaming can effectively be reduced to any major extent is to reduce the speed at which the web is carried through the bath. This, of course, results in undue delay and oversaturation when only a surface film is desired.

BACKGROUND OF THE INVENTION

We have surprisingly reduced or substantially overcome one or more of the aforementioned problems.

It is, therefore, an object of the present invention to provide an improved method and apparatus for depositing material to an object.

Another object of the present invention to provide an improved method and apparatus for applying a coating material to a moving web of material.

Another and further object of the present invention is to provide an improved method and apparatus for applying aqueous coating solutions to a moving web of wet material.

Still another object of the present invention is to provide an improved method and apparatus for applying a coating material to a moving web of material where a surprisingly even coverage of the web is obtained.

A further object of the present invention is to provide an improved method and apparatus for applying a coating material to a moving web of wet material wherein the coating is sprayed through a dispersing medium.

A still further object of the present invention is to provide an improved method and apparatus for applying a coating material to a moving web of material wherein the coating is sprayed onto the inside of a conveyor and carried through the conveyor belt onto the web of material.

Yet another object of the present invention is to provide an improved method and apparatus for applying coating material to a moving web of material wherein the coating is sprayed onto the inside of a top contacting conveyor and carried by the force of the spray through the contacting conveyor onto the surface of the web.

Another object of the present invention is to provide an improved method and apparatus for applying an aqueous coating of material to a moving web of wet material wherein the coating is sprayed onto the inside surface of an endless top forming fabric conveyor and carried by vacuum through the top forming fabric onto the surface of the wet material.

A still further object of the present invention is to provide an improved method and apparatus for applying an aqueous coating material to a moving web of wet material wherein the coating is sprayed onto the inside of the top wire, the endless belt conveyor used as a de-watering device in the papermaking process, and carried through such wire by an artificial vacuum positioned on the underside of the moving web.

A further object of the present invention is to provide an improved method and apparatus for applying a coating material to a moving web of wet material wherein the coating is sprayed through a dispersing material, positioned between the sprayer and the web, and carried partially by the force of the spray and subsequently by vacuum through such dispersing material and onto the web.

These and other objects of the present invention will become readily apparent after studying and understanding the present invention, as hereinafter described.

SUMMARY OF THE INVENTION

The present invention provides an efficient and effective method and apparatus for the controlled deposition of various types of chemicals in a liquid, semi-liquid and/or dry form to an object. One form of apparatus for carrying out the present invention comprises a relatively flexible porous conveyor in the form of a wire screen, typically referred to as a wire or forming fabric. The web is initially supported and conveyed on this wire and may undergo any number of process steps known in the industry such as drying, pressing, calendaring etc.

At some point, or even directly, after the paper forming step the web is typically contacted on the upper surface by the outer surface of a second endless wire. The defined path of travel of this second wire converges, at this point, with the traveling web arranged on the bottom wire. Conventionally, the purpose of this second wire is to assist in removing water from the web and/or to effect the characteristics of the upper surface.

The present invention surprisingly places a dispensing means above, typically just above, this second wire and dispenses preferably in the form of a spray a material intending to be applied to the web onto the exposed inner surface of the second endless wire (i.e. the surface opposing that surface which is in contact with the web). The material is then transferred through this permeable wire either simply by the force of the spray, gravity (depending on the arrangement of dispensing means to the wire and web), and/or vacuum positioned on the opposite side of the web from the dispensing means. The resulting distribution of coating material on the web is uniform and free of any spray patterns, thus, reducing the annoyance of carefully and precisely maintaining the arrangement of the spray nozzles.

DETAILED DESCRIPTION OF THE DRAWINGS

Figure 1:
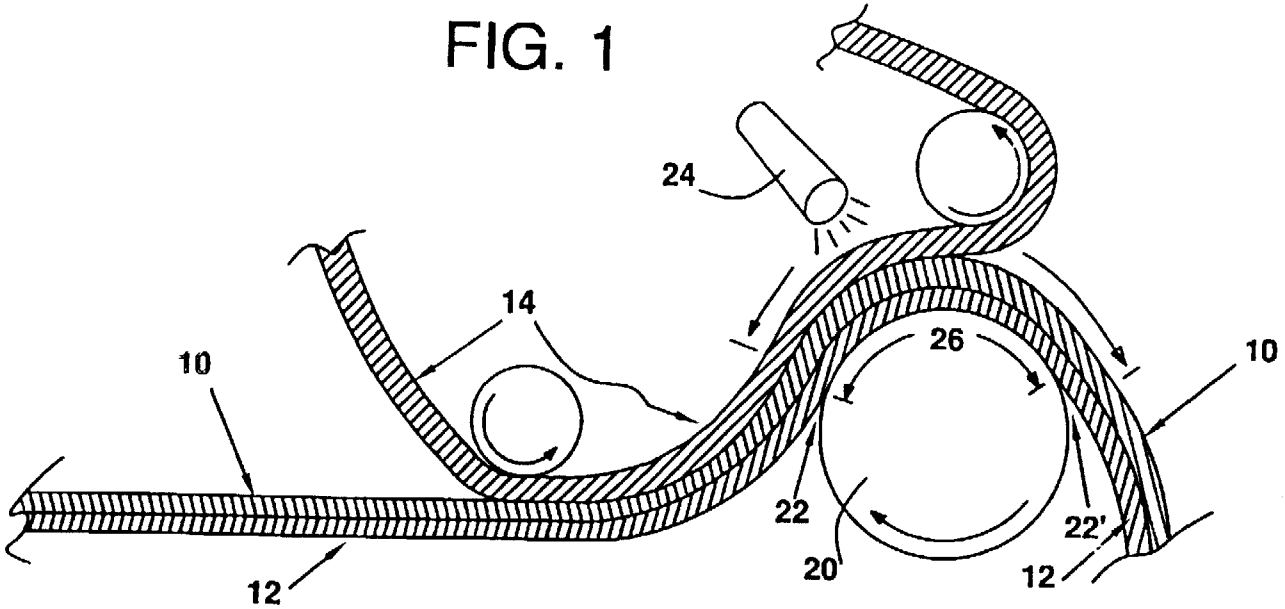
FIG. 1 is a side view of a diagrammatic illustration of apparatus suitable for carrying out the process of the present invention.

Before the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

A fibrous continuous web is formed in any desired conventional manner such as on a paper forming machine. The fibrous web is conveyed typically on an endless flexible screen conveyor, sometimes referred to as a forming fabric, blanket or wire, through various operations. Optionally, the felted web may be transferred to subsequent endless conveyors or carriers for transport through the various process step.

The newly formed web, or optionally a pre-formed web, is conveyed on an endless wire to a position wherein the exposed surface of the web is brought into contact with the outer surface of a second endless wire, positioned oppositely with respect to the web from the first, such that the web is confined between the first and second wires. Typically, the first wire is in contact with the bottom surface of the web and the second wire is in contact with the top surface. The wires are desirably in the form of a water permeable endless screen or felt constructed so as to permit adequate passage of the coating material for instance by the top forming fabric onto the web while at the same time enabling excess water, particularly by the bottom forming fabric, to be drawn away from the web.

The web now confined between these wires is conveyed through a spray point in which a spray of material is introduced onto the inner surface of one of the wires, typically, the wire in contact with the top surface of the web. The coating will be required to pass through the wire prior to contacting the web.

There are several means which may be utilized to assist passage of the coating through the material. Typically, the system will be designed such that the force of the spray will cause the coating to at least partially penetrate the top forming fabric. The system may be further equipped with a vacuum means to assist the passage of coating through the dispersing material by drawing a vacuum, either at the spray point and/or subsequent to the spray point, on the bottom side of the web. Typically, a vacuum zone will be arranged such that the spray point is within the vacuum zone which will tend to produce a downward current in the spray area for assisting the airborne coating particles toward the web. This is particularly useful when the web and dispersing means are travelling at rates of speeds which produce undesirable air currents about the spray point and/or the sprayed coating is in the form of small particles.

The coated web, still confined between the two wires, is conveyed by the first wire over a couch roll, a perforated roll having an internal mechanical vacuum. The inner surface of the first wire contacts the periphery of the couch roll and travels along a portion of the periphery. The vacuum system in the couch roll is arranged to approximately correspond with the contact area of the couch roll with the wire. This vacuum is preferably arranged such that the coating material is drawn into contact with the web in a fashion analogous to a vacuum filtration process. The vacuum also maintains the web in position against the first wire while the second wire is stripped or removed away from the web.

The coated web then proceeds through a series of other processes which may include heating, drying, pressing, further coating, calendaring, etc. Depending on the type of material deposited on the web, one of the subsequent operations may include a curing step. This may be accomplished by any means suitable for this purpose including bringing the uncoated surface of the web in contact with the periphery of a heated drum, typically steam heated, which will tend to cure the coating on the web.

A simplified system for practicing the present invention may include a dispensing device, such as a sprayer, for presenting deposition material, for instance a coating, through a dispersing medium to an object including a web of material. A spray of coating material will be introduced onto one side of the dispersing medium such that it passes through such medium prior to contacting the web.

The dispersing medium may be of any form or construction provided that it enables the coating to pass through while at least partially obstructing or interfering with at least a portion of the coating as it travels toward the web. Ideally, this dispersing material will be designed so as to optimize the uniformity of the coating onto the web such that any spray patterns are minimized and a regulated uniform deposition of coating is applied. The dispersing material may be fixed with respect to the web which is typically moving with respect to the spray point. Typically, the dispersing material will be moving with respect to the spray point and preferably moving along with the web.

The deposition material may be dispensed onto the web by any system or apparatus known for this purpose. Typically, the deposition material will be dispensed by spraying. The spray may be accomplished by any suitable means for this purpose including pneumatic and hydraulic spray devices. Typically, this will include an assembly composed of a plurality of nozzles or spray heads generally spaced at fixed intervals across the web path. These nozzles or spray heads are then connected to a system which provides pressure to force the material through the nozzles in the form of a spray or mist directed toward the surface of the web.

The deposition material may be fed to the spraying apparatus either as a hot or cold liquid, semi-liquid, melt and/or dry composition. It has been found in accordance with the present invention that the viscosity of the deposition materials, such as those which are normally solid or semisolid at ambient temperature, can be reduced by applying heat to the storage reservoir and/or the supply lines.

The deposition material may include any material known to be applied to an object via a dispensing means. More specifically, the deposition material dispensed to the object may be any material conventionally applied to a web of material such as those materials applied to impregnate the web, partially penetrate the web and especially those used to form a coating on the web. These materials may be selected from the group consisting of inorganic and/or organic coatings and pigments, synthetic resins and emulsions, wetting agents, surfactants, adhesives, optical brighteners, lubricants, static retardant agents, other conventional agents and additives, and mixtures thereof and any other materials which may be used to modify the character of the web. Preferably, the pigments are selected from a group consisting of calcium carbonate, clay and titanium dioxide and the adhesives are selected from a group consisting of latex, protein, starch, including hydroxyethylated starch and wheat starch. A preferred coating for practicing this invention is a hydroxyethylated starch and calcium carbonate solution.

The deposition materials of this invention may be dry compositions, suspensions, emulsions, dispersions, semi-liquids, and/or liquids. More typically, the materials will be aqueous compositions with between 1 and 99% solids content by weight of the total composition, preferably between 1 and 50% solids content, by weight of total composition, and more preferably between 5 and 20% solids content by weight of the total composition. The solids content in these compositions, typically, range from 50 to 100% pigment, 0 to 50% adhesive and 0 to 5% other additives and preferably 80 to 95% pigment, 5 to 20% adhesive and 0 to 5% additives. A preferred coating of the present invention is an aqueous composition comprising about 15% solids by weight of the total compositions in which the solids are composed of about 90% calcium carbonate and about 10% wheat starch by weight of solids.

Spray coating of the web can be accomplished in accordance with the present invention at web speeds anywhere from 0 to 6000 feet per minute or more, but better results are obtained at speeds between 3000 to 5000 and preferably between 3500 and 4500 feet per minute. The speed or coating application rate can of course, be preselected and easily changed to vary the amount of coating material deposited on the web. A sufficient amount of material can be deposited in a manner so as to produce either a surface film on the web, a saturated web or any degree of saturation therebetween.

The system will typically be equipped with a vacuum source positioned inside the inner surface of and directed toward the bottom wire at a position such that a vacuum effect is imposed at least on the web arranged on the opposing side of the wire. The source will typically extend the width of the web and be arranged such that a vacuum is drawn on the web after the spray point and preferably including the spray point. This vacuum may be produced by any conventional means and may be applied by any conventional technique including a vacuum box, channel, or slot. Preferably, the vacuum is applied by means of a couch roll, as described herein.

Referring to the drawings, a web 10, which has just been formed, for example, on a conventional paper forming machine, is arranged on a flexible porous conveyor 12 which may be in the form of an endless wire screen. The web 10 as it is conveyed by the flexible wire 12 is brought into contact with a second endless flexible porous conveyor, wire, 14 arranged above the web.

The second wire 14 contacts the top exposed surface of the web 10, at a point where the paths of the first and second wires converge, while the first wire 12 remains in contact with the web. The movement of the top and bottom wires are synchronized as they confine and carry the web toward the couch roll 20. Both wires have endless continuous paths of travel defined by a series of rollers. The defined path of travel of the bottom wire includes contacting a portion of the periphery of the couch roll 20.

The top and bottom wires remain in contact with the web as the bottom wire contacts the periphery of the couch roll and commences its travel along the periphery of the roll. The couch roll 20 is a vacuum roll comprising an air permeable circumferential surface and a vacuum source that tends to draw a vacuum radially inward. The vacuum is arranged such that this radially inward vacuum is imposed on the bottom wire throughout the area of contact, thus, defining the vacuum zone 26.

Positioned just beyond the juncture 22 were the bottom wire commences contact with the couch roll is the sprayer 24. The sprayer is positioned just above the inner surface of the top wire with the spray substantially directed toward the wire. It has been found useful to have the spray arranged within the vacuum zone to assist in directing the free falling spray particles toward the web and effectively eliminating spray lose to the surroundings. The spray is introduced to the inner surface of the top wire and travels through the top wire and onto the top surface of the web. This progression of the sprayed material is accomplished by the force of the spray in cooperation with the draw of the vacuum. At a point after where the spray is introduced but prior to the juncture 22' where the bottom web separates from the surface of the couch roll, the top wire is stripped from the web as the defined paths of the two wires diverge. The coated web then continues on through a series of finishing steps.

Figure 2:
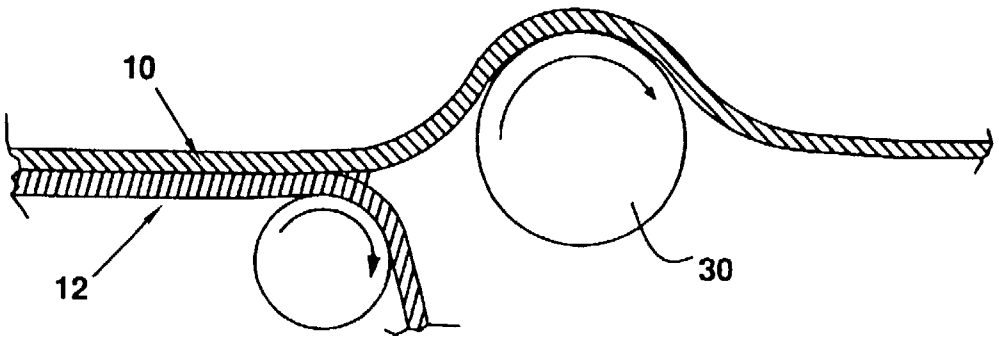
FIG. 2 is a side view of a diagrammatic illustration of the curing apparatus.

Depending on the nature of the coating material, one of these finishing steps may include a curing process. The curing of the coating is accomplished by training the bottom surface of the web against the periphery of the heated drum 30 (see FIG. 2). The heated drum will elevate the temperature of the web and the coating to the curing temperature of the coating.

It will be appreciated that there are advantages to spray coating in-line, however, this same apparatus and process can be performed off-line, that is on a process line, separate in time and/or location, from the one on which the web is formed.

What is claimed is:

1. An apparatus for dispensing a material onto a web, said web having first and second opposite surfaces, comprising:

first conveyor means for transporting the web and having a top surface engaging said first web surface and a bottom surface;

second conveyor means engaging a given portion of said second web surface, said second conveyor means comprising an endless permeable belt having an outer surface engaging said second web surface, and an inner surface; and, dispensing means mounted adjacent to said second conveyor means for dispensing the material onto said inner surface of said second conveyor means;

wherein at least some of said material passes through the second conveyor means onto the web.

2. The apparatus of claim 1 wherein said first conveyor means comprises an endless, permeable belt.

3. The apparatus of claim 1 including vacuum means engaging said first conveyor means bottom surface, for drawing the material into the web.

4. The apparatus of claim 3 wherein said vacuum means engages said first conveyor means along said given web portion.

5. The apparatus of claim 4 wherein said vacuum means comprises a vacuum couch roll.

6. The apparatus of claim 1 wherein said dispensing means comprises a spray nozzle.

7. The apparatus of claim 6 wherein said dispensing means dispenses the material with sufficient force to cause the material to penetrate said second conveyor means.

8. The apparatus of claim 7 wherein said dispensing means dispenses the material with sufficient force to cause the material to penetrate said second conveyor means and into said web.

9. An apparatus for dispensing a quantity of material onto a web, said web having first and second opposite surfaces, comprising:

first conveyor means for transporting the web and including belt means having a top surface for engaging said first surface and a bottom surface;

second conveyor means engaging a given portion of said second web surface dispensing means mounted adjacent to said second conveyor means for delivering the material to said second conveyor means at said given portion; and vacuum means engaging said belt means bottom surface beneath said given portion of the web, for drawing said material toward said given portion and into the web.

10. The apparatus of claim 9 wherein said vacuum means comprises a vacuum couch roll.

11. The apparatus of claim 9 wherein said second conveyor means comprises an endless, permeable belt.

12. The apparatus of claim 9 wherein said dispensing means comprises a spray nozzle.

13. The apparatus of claim 12 wherein said dispensing means dispenses the material with sufficient force to cause the material to penetrate said second conveyor means.

14. The apparatus of claim 13 wherein said dispensing means dispenses the material with sufficient force to cause the material to penetrate said second conveyor means and into the web.

15. An apparatus for evenly dispensing a of material to a moving web of paper, said web of paper having first and second opposite surfaces, comprising:

a first continuously circulating endless permeable belt for transporting the web having an outer surface for engaging said first web surface and an inner surface;

a second continuously circulating endless permeable belt synchronized with said first belt for engaging a portion of said second web surface, said second belt having an outer surface for engaging said second web surface and an inner surface;

dispensing means mounted adjacent to said second belt inner surface comprising a plurality of nozzles to deliver the material to said inner surface of said second conveyor means;

pressurizing means communicating with said plurality of nozzles for forcing the material through said plurality of nozzles against said second belt inner surface and toward said portion of the web with sufficient force to cause the material to at least partially penetrate said second belt;

a rotatable drum mounted adjacent said first belt inner surface beneath said portion of the web and having an air-permeable wall; and vacuum means disposed in said rotatable drum for drawing said material into the web.

* * * * *